US008893459B2

(12) United States Patent
Hecktor et al.

(10) Patent No.: US 8,893,459 B2
(45) Date of Patent: Nov. 25, 2014

(54) CLOSURE DEVICE

(75) Inventors: Jan Peter Hecktor, Weitersburg (DE); Marius Michael Herrmann, Rosenheim (DE)

(73) Assignee: KHS GmbH, Dortmund (DE)

( * ) Notice: Subject to any disclaimer, the term of this patent is extended or adjusted under 35 U.S.C. 154(b) by 666 days.

(21) Appl. No.: 12/997,225

(22) PCT Filed: Jul. 10, 2009

(86) PCT No.: PCT/EP2009/005035

§ 371 (c)(1),
(2), (4) Date: Dec. 9, 2010

(87) PCT Pub. No.: WO2010/022818

PCT Pub. Date: Mar. 4, 2010

(65) Prior Publication Data

US 2011/0162332 A1 Jul. 7, 2011

(30) Foreign Application Priority Data

Aug. 28, 2008 (DE) ..... 10 2008 044 696

(51) Int. Cl.

| | |
|---|---|
| ***B65B 7/28*** | (2006.01) |
| ***B67B 3/06*** | (2006.01) |
| ***B67B 3/28*** | (2006.01) |
| ***B67B 3/26*** | (2006.01) |

(52) U.S. Cl.

CPC .. *B67B 3/264* (2013.01); *B67B 3/06* (2013.01)
USPC ..... 53/485; 53/55; 53/76; 53/287; 53/306

(58) Field of Classification Search

CPC ..... B65C 9/08; B65B 55/04; B65B 7/28; B65B 7/2842; B67B 3/06; B67B 3/20; B67B 3/2013; B67B 7/2807; B67B 7/2835
USPC ..... 53/55, 485, 490, 505, 306, 287, 76
See application file for complete search history.

(56) References Cited

U.S. PATENT DOCUMENTS

| | | | | | |
|---|---|---|---|---|---|
| 2,528,912 | A | * | 11/1950 | Rappaport et al. | 198/394 |
| 2,680,549 | A | * | 6/1954 | Levy | 53/295 |
| 3,415,034 | A | | 12/1968 | Schmitt | |
| 3,710,921 | A | | 1/1973 | Petiet | |
| 3,934,714 | A | * | 1/1976 | Matsumoto | 198/379 |
| 4,065,909 | A | * | 1/1978 | Mueller | 53/420 |
| 4,238,267 | A | * | 12/1980 | Konstantin | 156/379.6 |
| 4,870,806 | A | * | 10/1989 | Sprenger | 53/485 |
| 4,993,537 | A | * | 2/1991 | Bianchini et al. | 198/395 |
| 5,054,260 | A | * | 10/1991 | Herzog | 53/307 |

(Continued)

FOREIGN PATENT DOCUMENTS

| | | |
|---|---|---|
| DE | 963 223 | 5/1957 |
| DE | 1 183 392 | 7/1962 |

(Continued)

*Primary Examiner* — Gloria R Weeks
(74) *Attorney, Agent, or Firm* — Occhiuti & Rohlicek LLP

(57) ABSTRACT

An apparatus for closing containers includes a supplying device for supplying a closure element to a container. The supplying device includes a cap detecting system that records a random position of the closure element and is designed to hold the closure element in the random position and to convey it in a circumferential direction while maintaining it in this random position.

20 Claims, 4 Drawing Sheets

(56) References Cited

U.S. PATENT DOCUMENTS

Figure 1:
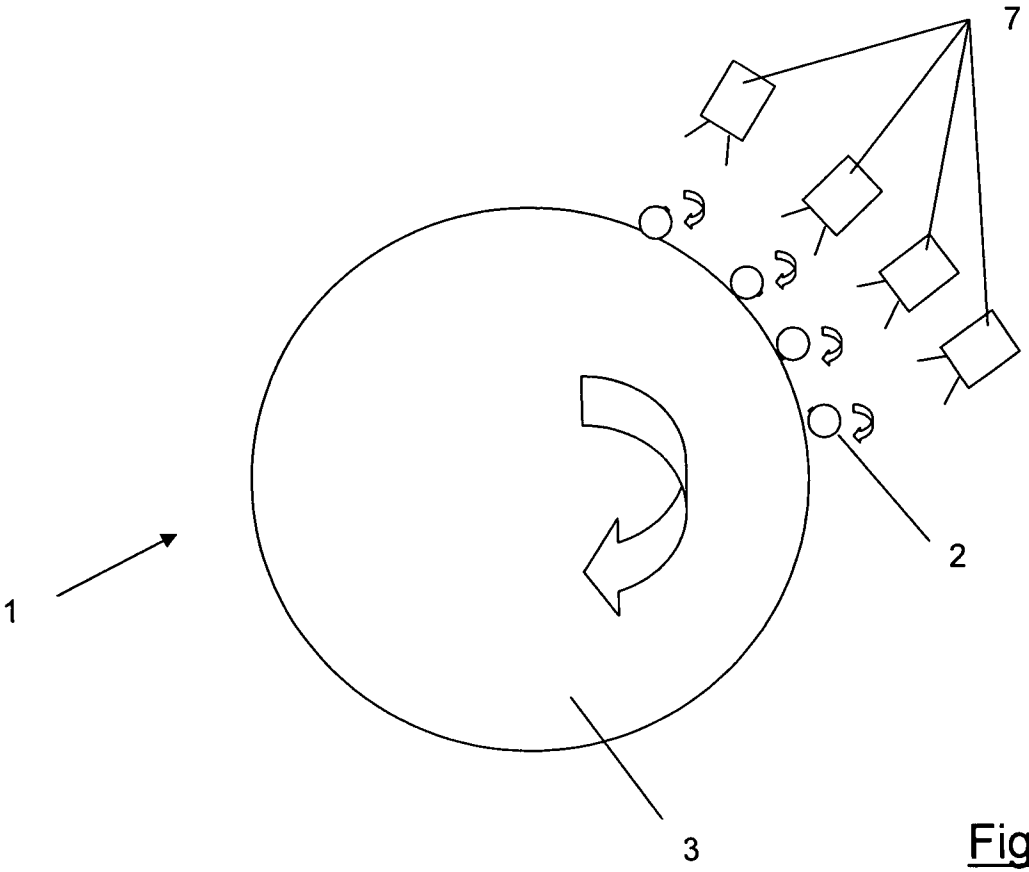

| | | | | |
|---|---|---|---|---|
| 6,105,343 | A * | 8/2000 | Grove et al. | 53/490 |
| 6,341,472 | B1 * | 1/2002 | Schroeder | 53/426 |
| 6,398,006 | B1 * | 6/2002 | Dault | 198/377.01 |
| 6,484,478 | B1 * | 11/2002 | Arends et al. | 53/544 |
| 6,564,529 | B2 * | 5/2003 | Reinecke | 53/303 |
| 6,688,465 | B2 * | 2/2004 | Arends et al. | 206/427 |
| 6,708,748 | B1 * | 3/2004 | Kronseder et al. | 156/570 |
| 6,868,652 | B2 * | 3/2005 | Arends et al. | 53/446 |
| 7,412,813 | B2 * | 8/2008 | Heil et al. | 53/487 |
| 7,497,323 | B2 * | 3/2009 | Davidson et al. | 198/474.1 |

FOREIGN PATENT DOCUMENTS

| | | |
|---|---|---|
| DE | 201 15 480 | 5/2002 |
| DE | 10 2006 019441 | 10/2007 |
| EP | 0399354 | 11/1990 |
| EP | 1197468 | 4/2002 |
| EP | 1 803 681 | 7/2007 |
| GB | 1036270 | 7/1966 |
| GB | 2 358 467 | 7/2001 |
| WO | 2009/077948 | 6/2009 |

* cited by examiner

CLOSURE DEVICE

CROSS-REFERENCE TO RELATED APPLICATIONS

This application is the National Stage of International Application No. PCT/EP2009/005035, filed on Jul. 10, 2009, which claims the benefit of German Application Serial No. 10 2008 044 696.3, filed on Aug. 28, 2008. The contents of both of the foregoing applications are hereby incorporated by reference in their entirety.

The invention relates to a device for closing containers, said device including a supplying device, wherein a closure element is supplied to the container by means of the supplying device.

These types of devices supply closure elements to containers or to their mouth opening in order to close said mouth opening in a sufficient manner. Closure elements are known, for example, as crown caps. Crown caps have an outside cap and a flange that includes an inside.

DE 963 223 is concerned with machines for closing bottles and other vessels with crown caps. These machines have so-called cap mills, to which the crown caps are supplied from a cap container. At the correct position, the cap mills allow the caps to drop into a channel that leads to the closing head. In order to achieve an orientation of the crown caps such that the inside is always deposited onto the mouth opening of the container, DE 963 223 proposes providing two discs, which are located at the outlet of the cap mill in a plane one above the other, rotate in the same direction and have magnets located therein. The crown cap abutting against the bottom disc with the cap is conveyed into a channel and supplied directly to the closing head. The crown cap abutting with its flange is detected by the magnet of the top disc, is diverted via the rotation of the disc and thus conveyed into a channel and supplied to the closing head. Consequently, a forcible orientation of the crown caps is achieved by means of a magnetic sorting procedure, the crown cap being oriented in each case with its cap upward and its flange downward.

DE 1 183 392 relates to a supplying and sorting device on a closing machine for crown caps with removal tabs, where a channel leading to a closure element is connected radially to a rotating cap disc. In order to supply the crown caps with removal tabs in the aligned manner and in close succession to the closing element, DE 1 183 392 proposes providing a tongue, which is located transversely relative to the inlet opening of the channel, parallel to the edge of the cap disc within the hopper and extends the channel in the circumferential direction of the cap disc. By means of the removal tabs, the crown caps are pivoted such that their longest extension corresponds to the direction of movement.

Containers of the aforementioned type can be used, for example, as bottles for liquids, for example for beverages. The containers, e.g. bottles, can be produced from a transparent or translucent material, for example glass, or a translucent plastics material, e.g. PET. It is also conceivable, however, for the containers to be produced from other materials and to be fillable with other liquid products.

The filled containers are supplied to a labeling machine. Prior to labeling, at an orienting station the containers are rotated into a certain position such that the labels are always arranged in an identical position on the respective container. This is achieved by the orienting station having at least one detecting station, preferably a plurality of detecting stations, which recognize development features, e.g. so-called embossings of the container, relative to which the labels or other identifications are to be oriented and positioned as precisely as possible. By means of the at least one detecting system, preferably a plurality of detecting systems, the entire periphery of the container is detected, the containers being moved past the detecting systems mounted on turntables and rotating. Once the containers have passed the detecting system or systems, the containers are rotated correspondingly via the turntables into the desired position by means of the signals generated by the detecting systems. Once the container is correctly oriented, it is labeled such that labels are always oriented identically and as desired preferably in relation to the development features (embossings).

Prior to labeling, however, the container is closed by means of the closure element. By means of the teaching of DE 963 223 it is now possible always to deposit the closure elements on the mouth opening with their flanges oriented relative to said mouth opening.

It is conceivable that the closure element has a decoration or identifying mark on its cap, for example a mark of a beverage manufacturer. As practice shows, the closure elements are moved with their identifying mark arranged on the cap but in a random manner with reference to the development features and consequently also to the labels, that is they are quasi rotated. All in all, this produces a faulty image of the container, based on the containers oriented carefully and at great expense after the closing process and of labels or of similar identifying marks deposited thereon.

It is the object of the invention to improve a device of the aforementioned type using simple means, such that the closure elements can be arranged on the container with their cap always oriented in an identical manner, for example in relation to labels and/or development features.

According to the invention, the object is achieved by a device with the features of claim 1, wherein the supplying device has a cap detecting system, which records a random position of the closure element, and wherein the supplying device is realized such that the closure element is held and can be conveyed in the supplying device in the random position in a non rotatable manner in its circumferential direction. The object is also achieved, however, by a method with the features of claim 15.

In an expedient manner, the device according to the invention has a container detecting system, past which the containers are moved whilst rotating. By means of the container detecting system, which has at least one, preferably several cameras, development features (embossings) of the container are recognized, the respective container being rotatable on turntables.

First of all the closure element is supplied to the supplying device by means of suitable conveyors. At this juncture the closure elements are already preferably aligned such that they are oriented with their flange downward, meaning that the cap is directed away from the conveyor.

The supplying device includes the cap detecting system, which is located such that said cap detecting system generates a head-on photograph of the respective closure element or of its cap-side decoration in whatever random position it presents itself when the closure element is moved past the cap detecting position.

In an expedient manner, both the photographs and the data of the container detecting system and of the cap detecting system are then combined such that the container on the turntable is rotated in relation to the recognised, random position of the decoration of the respectively associated closure element. As, in an advantageous manner, the closure element is transported in its recognized random position in its circumferential direction in a non rotatable manner relative to the container, the closure element with its cap-side decoration is placed or deposited on said container or on its mouth opening always identically oriented relative to the development features (embossings) of the container. Once it has been placed or deposited on the container or on its mouth region, a closure element brings about a sufficiently sealed closure of the container.

In a first development, the supplying device is formed by two transport wheels that rotate in opposite directions. A first transport wheel takes the closure elements from the conveyor, and rotates them past the cap detecting system, which recognizes the decoration or other markings on the cap. Development features (embossings) of the container have already been recognised prior to this (container detecting machine).

The respective closure elements are mounted on the first transport wheel for recording the cap-side decoration such that their flange is oriented in the direction of a central point of the transport wheel and the cap is oriented towards the cap detecting system.

So that the closure elements can be placed or deposited onto the mouth opening of the container with their flanges oriented towards a bottom of said container, it is provided in an advantageous manner that the first transport wheel transfers the closure elements to a second transport wheel, such that the previously mentioned orientation in each case is reversed. The closure elements are therefore mounted at the second transport wheel in an advantageous manner such that the flanges are oriented away from the central point of the second transport wheel.

In an expedient manner it is provided that the closure elements are mounted in a force locking manner at the respective transport wheels. It is conceivable, for example, that the closure elements are held by means of magnetic means. This is sensible where magnetic closure elements are used.

However, it is also conceivable for the closure elements to be held at the transport wheels by means of pneumatic means (suction device), which is sensible, for example, for plastics material closures or other non-magnetic closures. Naturally, one of the transport wheels can have magnetically operating means and the other pneumatically operating means. Obviously, other suitable means for holding the closure elements at the transport wheels can be provided.

In a preferred development, the respective transport wheels, when viewed in their respective circumferential direction, have holding devices distributed thereon. The holding devices are realized in the preferred development as flattened projections, which, with their receiving side, extend away from the circumferential face of the transport wheel in the radial direction. The holding devices include the holding means (pneumatic, magnetic).

As the position of the respective closure elements on the respective transport wheel is held advantageously in an invariable manner, the container can be rotated correspondingly into the correct position (turntable) relative to the respectively associated closure element. Obviously, the transport wheels are realized corresponding to the spacing between adjacent containers such that the respective closure element can be placed or deposited in each case on an associated container.

In a second development, the supplying device is advantageously realized as a hollow cylinder, which is open on two sides and which, in a preferred development, has an anti-rotation inside contour. Ribbing, located for example parallel to a central axis, can be introduced on the inside of the hollow cylinder, said ribbing preventing the closure element from rotating. However, it is also conceivable for an inside diameter of the hollow cylinder to be adapted to an outside circumference of the closure element such that rotation is prevented, but axial transport of the closure element is ensured by the hollow cylinder.

The closure elements are supplied to the hollow cylinder by means of the conveyor, and pass from a head end of the hollow cylinder into said conveyor. The cap detecting system is located at the head end of the hollow cylinder and thus looks in each case onto the cap-side decoration of the last in-coming or occurring closure element, and stores the random position of the decoration.

In an advantageous manner, a plurality of closure elements are stacked one above the other when viewed in a longitudinal direction of the hollow cylinder. A rotating of the closure element can also be avoided by the resultant weight together with the anti-rotational inside contour.

As the containers are usually moved past the hollow cylinder spaced apart, it is advantageous to provide a retaining device at a bottom end of the hollow cylinder situated opposite the head end, said retaining device preventing the closure element falling into the gap between two adjacent containers in an unwanted manner. It is obviously also possible to realize the retaining device with an anti-rotation means.

By means of the device according to the invention, the achievement is that closure element is oriented in a targeted manner with its cap-side decoration in relation to development features (embossings) of the container, and consequently to labels or other container identifying markings to be attached subsequently, without the closure element being oriented. Rathermore, just a random position of the closure element is recorded and stored, which means that it is just the containers that have to be rotated into the respectively correct position relative to the closure element. Once the closure element has been placed or deposited onto the mouth opening of the container, a closing element connected downstream brings about a sufficient closing of the container.

The visual appearance of the closure element and how it is perceived by the consumer are improved by the targeted orientation of the closure element.

The closure element can be realized as a bounceable closure such as, for example, as a crown cap. However, a closure element developed as a so-called maxi crown, twist-off or ring-pull is also conceivable. In the case of a ring-pull, for example, there is the easily recognizable advantage of the ring being oriented in a targeted manner to development features (embossings) of the containers or labels. In this respect, the closure elements according to the invention do not absolutely have to have a cap-side decoration. Rathermore, the invention is to also include an orienting of the closure element according to its development features and/or its functional features.

It is also conceivable for the closure element to be realized as a screw-type closure.

Another advantage of the invention is that an orienting station with a plurality of detecting systems could be dispensed with in the inlet of the labeling machine. Just one single detecting system would suffice here, simply recording the position of the closure element as said closure element has already been oriented in relation to development features (embossings) of the container using the present invention. The detecting system would look from above onto the closure element and bring about a corresponding orientation of the container standing upright on the turntable. Consequently, it is possible to produce the labeling machine in a more cost-efficient manner as a plurality of detecting systems for detecting development features (embossings) of the container can be dispensed with. Rathermore, one single cap detecting system to be controlled from above would be sufficient to orientate the containers which means that the labels can be applied precisely oriented in relation to development features of the container (and to the closure element). Naturally, this is only sensible for closure elements that have corresponding development features and/or functional features.

Figure 2:
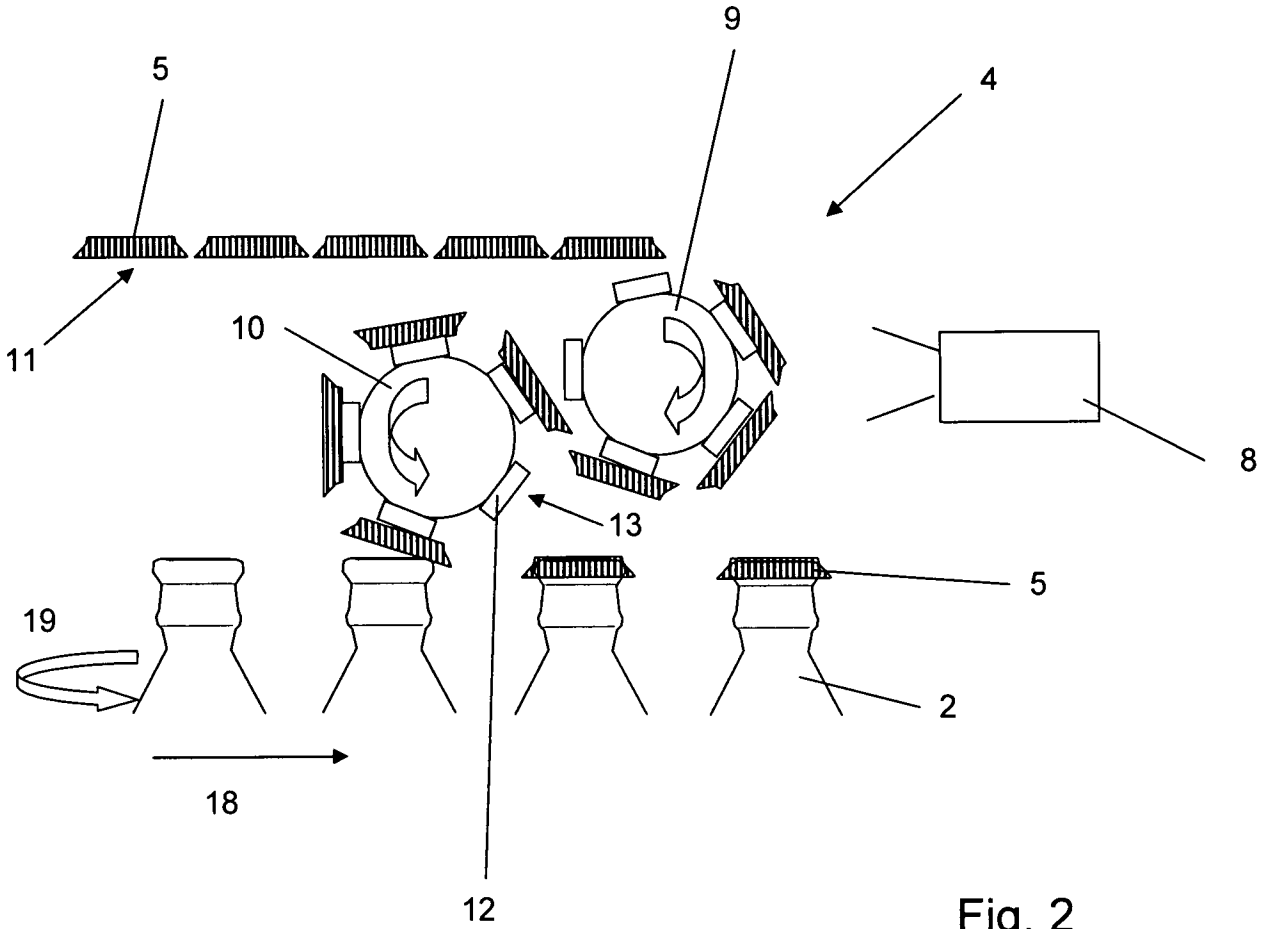
Figure 3:
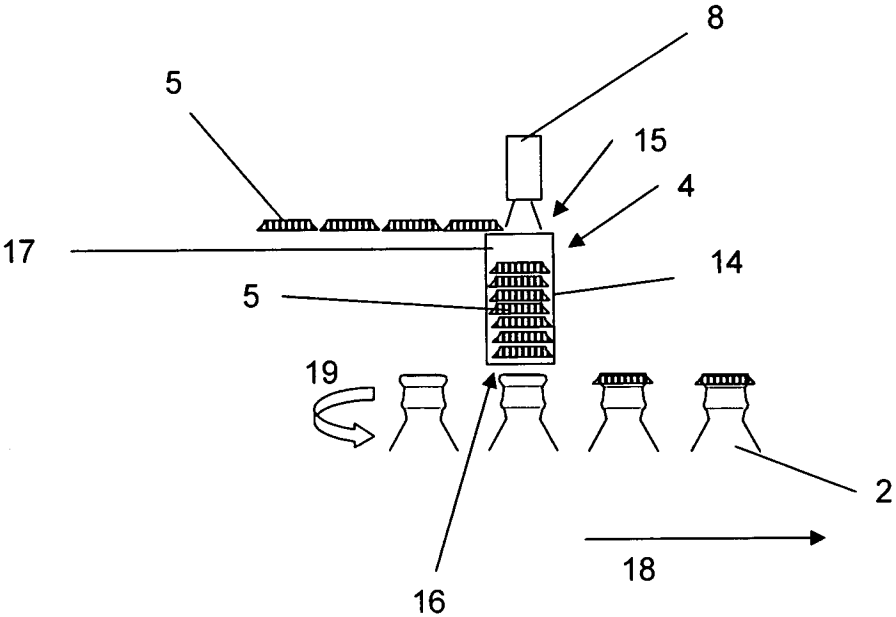
Figure 4:
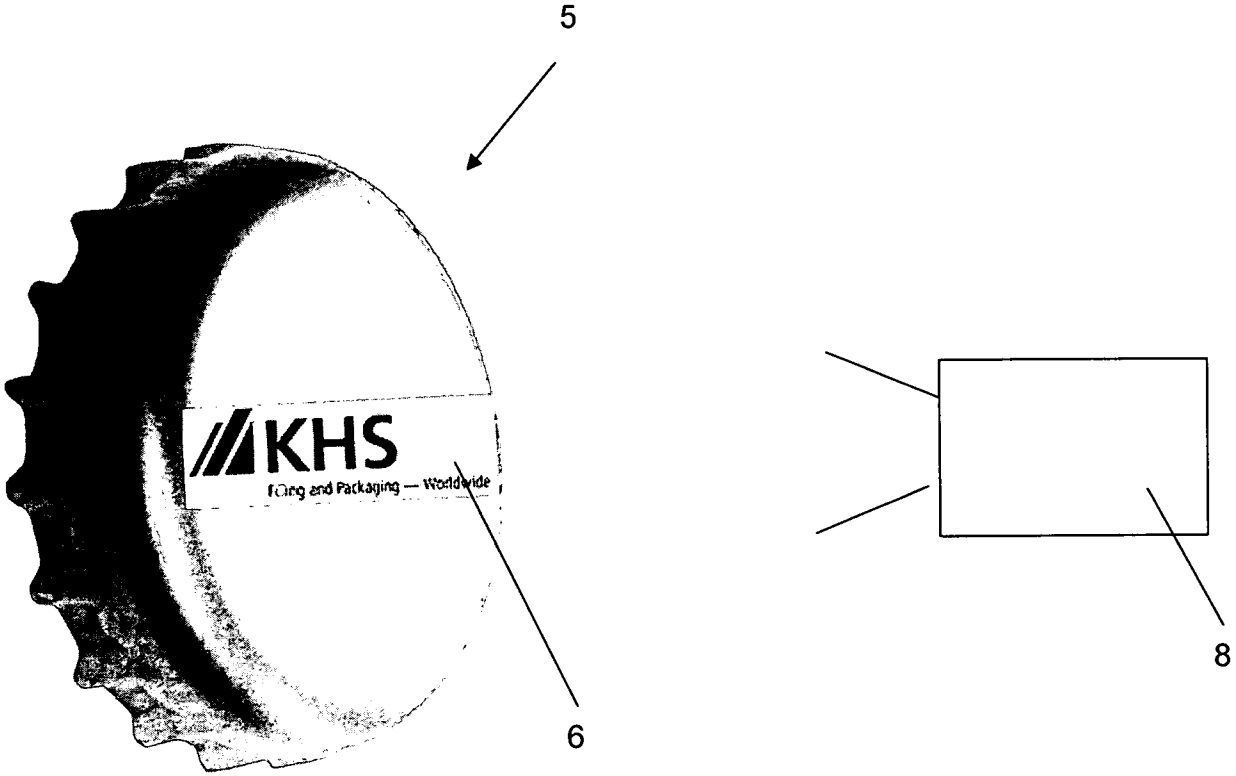

Further advantageous developments of the invention are disclosed in the sub claims and the following description of the Figures, in which:

FIG. 1 shows a device for closing containers, said device including a closure distributing means as a unit, FIG. 2 shows a first development of a supplying device and FIG. 3 shows a second development of a supplying device and FIG. 4 shows, as an example, a photograph of a cap-side decoration of a closure element taken by a cap detecting system.

Identical parts in the various Figures are always provided with the same references, which is why, as a rule, they are only described once.

FIGS. 1 and 2 show a device 1 for closing containers 2. In the embodiment represented, the containers 2 are realized as bottles, for example beverage bottles.

The device 1 has a closure distributing means 3 (FIG. 1) and a supplying device 4 (FIG. 2). Closure elements 5 are supplied to the container or containers 2 in each case by means of the supplying device 4.

In the embodiment represented (FIG. 4), the closure element 5 is realized as a crown cap, which has a cap-side decoration 6. The cap-side decoration 6 is realized, for example, as the trademark of the applicant. Other cap-side decorations or development features can obviously also be used.

FIG. 1 shows how the containers 2 are moved past, for example, four container detecting systems 7. The container detecting systems 7 are represented on principle as cameras. A connection between the cameras and image processing and control units is not shown. The containers 2 are mounted on actuatable turntables. The closure distributing means 3 rotates in a direction of rotation as shown. At the same time the turntables effect a rotation of the containers 2 in the same direction such that each of the container detecting systems 7 records a certain peripheral region of the container 2. Once the container 2 has passed all the detecting systems 7, an all-round image of the container 2 is obtained. Consequently, development features (embossings) of the container 2 are able to be recognized.

The supplying device 4 has a cap detecting system 8 (FIGS. 2 and 3). The cap detecting system 8 photographs a random situation or position of the closure element 5 or of its cap-side decoration 6 and forwards the data or images to the image processing and control unit. The cap detecting system 8 is represented on principle as a camera.

The supplying device 4 is realized such that the closure elements 5, when viewed in their circumferential direction, are held and can be transported in a non rotatable manner in the random position. The supplying device 4, when viewed in the direction of rotation of the closure distributing means 3, is located behind the container detecting system 7.

FIG. 2 shows a first development of the supplying device 4. The supplying device 4 has two transport wheels 9 or 10 that rotate preferably in opposite directions. In the embodiment represented, a first transport wheel 9 is located to the side in the drawing plane, with its central point vertically offset relative to a second transport wheel 10, the first transport wheel 9 being located higher in the transport plane than the second transport wheel 10.

The closure elements 5 are supplied to the first transport wheel 9 by means of a conveyor 11 such that the cap of the closure element 5 or the cap-side decoration 6 is oriented away from the central point of the first transport wheel 9.

The respective transport wheels 9 or 10 have holding devices for holding the closure element 5. The holding devices 12 are realized, for example, as projections, which, with their receiving side, extend away from the circumferential face of the respective transport wheel 9 or 10. The holding devices 12 have associated therewith magnetic and/or pneumatic holding means.

The first transport wheel 9 takes over the closure element 5 in the random position and moves the closure elements 5 in the random position past the cap detecting system 8. The cap detecting system 8, as already described, photographs the random position of the closure element 5 or of its cap-side decoration, and forwards the data photographed to the image processing and control units. In the embodiment represented, the cap detecting system 8 is located to the side of the first transport wheel 9 such that a full-on photograph of the closure element 5 or of its cap-side decoration 6 is possible. Naturally, the arrangement represented of the cap detecting system 8 is simply to be understood as an example.

The first transport wheel 9 transfers the closure element 5 in the random position to the second transport wheel 10, which transports the closure elements 5 in the random position in the circumferential direction in a non rotatable manner to the container 2 or to its mouth opening. At the second transport wheel 10, the closure elements 5 are mounted with their cap on the receiving side 13.

Prior to the closure element 5 being placed onto the container 2 or onto its mouth opening, the image processing and control units, by means of a comparison between the data from the container detecting system 7 and from the cap detecting systems 8, bring about a rotation of the container 2 (see arrow of rotation 19, it naturally being possible to rotate in both directions) relative to the closure element 5 by means of corresponding signals. In other words, the development features (embossings) of the container 2 are oriented in a targeted manner relative to the closure element or to its cap-side decoration 6.

The container or containers 2 are moved past the supplying device 4 or the second transport wheel 10 in the direction of transport (arrow 18, which may be shown in a linear manner but does correspond to the rotation of the closure distributing means 3). The closure element 5 is deposited on the container 2 or on its mouth opening in a manner that is loose-fitting but sufficiently positionally secure.

In the second exemplary embodiment shown in FIG. 3, the supplying device is realized as a hollow cylinder 14.

The hollow cylinder 14 has a head end 15 and a bottom end 16 that is situated opposite said head end. Both the head end 15 and the bottom end 16 are open. The hollow cylinder 14 is open at both ends in this respect.

The closure elements 5 are supplied to the hollow cylinder 14 via the conveyor 11 such that said closure elements pass into the hollow cylinder 14 oriented with their cap-side decoration 6 towards the head end 15.

The cap detecting system 8 is located above the head end 15 and thus looks head-on onto the closure element 5 or onto its cap-side decoration 6 within the hollow cylinder 14, once said closure system has passed into the hollow cylinder 14.

The supplying device 4 or the hollow cylinder 14 has such a type of inside contour that the closure element 5 can be transported to the container 2 in the random position established by the cap detecting system 8 in the circumferential direction in a non rotatable manner. The inside contour can have ribbing 17 for example. It is also possible for an inside diameter to be adapted to the outside circumference of the closure element 5 such that a rotating of the closure element 5 out of the established random position is avoided.

As FIG. 3 shows, a plurality of closure elements 5, when viewed in the longitudinal direction, are inside the hollow cylinder 14, stacked one above the other in the drawing plane represented. A rotating of the closure element 5 out of the random position is avoided through the resultant weight together with the advantageous inside contour of the hollow cylinder 14.

The cap detecting system 8 forwards the photographed data, as described above, to the image processing and control unit, in which, once again, a comparison is effected with the data from the container detecting system 7, such that the respective container 2 rotates relative to the closure element 5 into the desired position (rotation arrow 19, it naturally being possible to rotate in both directions) prior to the associated closure element 5 being placed onto the container 2 or onto its mouth opening.

The containers 2 are moved, as before, in the direction of transport 18 past the supplying device 4 or the hollow cylinder 14. The closure element 5 is placed in a sufficiently positionally secure manner onto the container 2 or onto its mouth opening.

Once the closure element 5 is placed onto the container 2 or onto its mouth opening, a closing means connected downstream brings about a sufficient closing of the container 2. This naturally also applies to the exemplary embodiment in FIG. 2.

The container 2 closed in this manner with the closure element 5 oriented in a targeted manner in each case relative to the development features (embossings) can be supplied to a labeling machine.

LIST OF REFERENCES

1 Device for closing
2 Container
3 Closure distributing means
4 Supplying device
5 Closure element
6 Cap-sided decoration of 5
7 Container detecting systems
8 Cap detecting systems
9 First transport wheel
10 Second transport wheel
11 Conveyor
12 Holding devices
13 Receiving side
14 Hollow cylinder
15 Head end
16 Bottom end
17 Ribbing
18 Direction of transport, container

The invention claimed is:

1. An apparatus for transporting closure elements, said apparatus comprising a supplying device, and a cap detecting system, wherein said supplying device is configured to transport a plurality of caps prior to application of each of said caps onto a corresponding container from a plurality of containers, wherein each of said caps has a feature that defines an angular orientation of said cap, wherein said angular orientation results from rotation of said cap about an axis defined by a line normal to a surface of said cap, wherein said closure element is configured to engage an opening of a container that is in an open state, thereby transforming said container into a container that is in a closed state, wherein each of said caps from said plurality of caps has a corresponding random angular orientation, wherein said supplying device is configured to hold each of said caps in said corresponding random angular orientation, wherein said supplying device is configured to transport each of said caps along a transport path, wherein during transport along said transport path, each of said caps retains said corresponding random angular orientation, and wherein said cap detecting system is placed along said transport path to record said corresponding random angular orientations prior to placement of said caps on corresponding containers, wherein, in said open state, a mouth of said container is open so that liquid can pass from outside said container into an interior of said container, wherein, in said closed state, said mouth is closed so that liquid trapped inside said container by a closure element can no longer pass from said interior of said container to outside said container as a result of said mouth having blocked by said closure element, whereby, by the time a closure element is first placed on a corresponding container, said random angular orientation of said closure element has already been recorded by said cap detecting system, and whereby said container can be rotated to a correct position corresponding to said random angular orientation before said closure element is first applied to said container, whereby containers that are in an open state are transformed into said closed state by application of said closure cap, wherein said closure cap has a first side on which said feature is present, and a second side opposite said first side, wherein said supplying device comprises a first transport wheel and a second transport wheel, wherein said first transport wheel and said second transport wheel rotate in opposite directions, wherein said first transport wheel receives said closure element from a conveyor and engages said closure element with said first face facing outward, said second side facing inward, and said feature having a first angular orientation, wherein said first transport wheel transports said closure element along a first circumferential path, wherein said first transport wheel transports said closure element towards said second transport wheel along said first circumferential path, wherein said first transport wheel engages said closure element so that said first side is viewable by said cap detecting system, wherein at a first point in said first circumferential path, said first transport wheel transports said closure element past said cap detecting system for inspection of said feature and determination of said angular orientation of said closure element based on said inspection, wherein at a second point in said circumferential path, said first transport wheel provides said closure element to said second transport wheel, wherein said second transport wheel receives said closure element at said angular orientation and transports said closure element with said angular orientation unchanged, wherein said second transport wheel transports said closure element received from said first transport wheel toward a container along a second circumferential path, wherein said second transport wheel engages said closure element so that said first side is facing said second transport wheel and said second side is facing outward, wherein, at a first point on said second circumferential path, said second transport wheel receives said closure element from said first transport wheel, wherein at a second point on said second circumferential path, said second transport wheel places said closure element on a container that has been rotated to receive said closure element based on data provided by said cap detecting system from inspection of said closure element while said first closure element was engaged by said first transport wheel, and wherein said second transport wheel places said closure element on said container with said first face facing outside said container.

2. The apparatus according to claim 1, wherein closure elements are mounted on said first transport wheel by a first force that pulls said closure element in a radial direction towards a center of said first transport wheel and prevents angular orientations of said closure elements from changing, and wherein closure elements are mounted on said second transport wheel by a second force that pulls said closure element in a radial direction towards a center of said second transport wheel and prevents angular orientations of said closure elements from changing.

3. The apparatus according to claim 2, wherein at least one of said first transport wheel and said second transport wheel comprises a magnetic element that applies said corresponding force.

4. The apparatus according to claim 2, wherein at least one of said first transport wheel and said second transport wheel comprises a pneumatic element that applies said corresponding force.

5. The apparatus of claim 4, wherein the other of said first transport wheel and said second transport wheel comprises a magnetic element that applies said corresponding force.

6. The apparatus according to claim 1, further comprising holding devices on the respective transport wheels, said holding devices each having a receiving side that extends away from a circumferential face of the transport wheels in a radial direction.

7. The apparatus of claim 1, further comprising a container detecting system, wherein containers that are in said open state are transported on turntables prior to application of closure elements, wherein said container detecting system provides data that, when combined with data provided by said cap detecting system, enables said containers on said turntable to be rotated in relation to the a recognized random orientation of said closure element.

8. The apparatus according to claim 1, wherein the cap detecting system is located for generating a head-on photograph of each closure element.

9. The apparatus according to claim 1, wherein the cap detecting system is located for generating a photograph of said feature.

10. An apparatus for transporting closure elements, said apparatus comprising a supplying device, and a cap detecting system, wherein said supplying device is configured to transport a plurality of caps prior to application of each of said caps onto a corresponding container from a plurality of containers, wherein each of said caps has a feature that defines an angular orientation of said cap, wherein said angular orientation results from rotation of said cap about an axis defined by a line normal to a surface of said cap, wherein said closure element is configured to engage an opening of a container that is in an open state, thereby transforming said container into a container that is in a closed state, wherein each of said caps from said plurality of caps has a corresponding random angular orientation, wherein said supplying device is configured to hold each of said caps in said corresponding random angular orientation, wherein said supplying device is configured to transport each of said caps along a transport path, wherein during transport along said transport path, each of said caps retains said corresponding random angular orientation, and wherein said cap detecting system is placed along said transport path to record said corresponding random angular orientations prior to placement of said caps on corresponding containers, wherein, in said open state, a mouth of said container is open so that liquid can pass from outside said container into an interior of said container, wherein, in said closed state, said mouth is closed so that liquid trapped inside said container by a closure element can no longer pass from said interior of said container to outside said container as a result of said mouth having blocked by said closure element, whereby, by the time a closure element is first placed on a corresponding container, said random angular orientation of said closure element has already been recorded by said cap detecting system, and whereby said container can be rotated to a correct position corresponding to said random angular orientation before said closure element is first applied to said container, whereby containers that are in an open state are transformed into said closed state by application of said closure cap, wherein said supplying device comprises a hollow cylinder configured to receive closure elements and to stack said closure elements inside said hollow cylinder.

11. The apparatus according to claim 10, wherein said hollow cylinder comprises an inner contour, wherein said inner contour prevents closure elements from changing angular orientation while said closure elements are inside said hollow cylinder.

12. The apparatus according to claim 11, wherein said inner contour of said hollow cylinder comprises ribbing.

13. The apparatus of claim 12, wherein said ribbing extends in a direction parallel to said cylinder.

14. The apparatus according to claim 10, wherein said cap detecting system is located at a head end of said hollow cylinder.

15. The apparatus of claim 10, further comprising a container detecting system, wherein containers that are in said open state are transported on turntables prior to application of closure elements, wherein said container detecting system provides data that, when combined with data provided by said cap detecting system, enables said containers on said turntable to be rotated in relation to the a recognized random orientation of said closure element.

16. The apparatus according to claim 10, wherein the cap detecting system is located for generating a photograph of said feature.

17. An apparatus for transporting closure elements, said apparatus comprising a supplying device, and a cap detecting system, wherein said supplying device is configured to transport a plurality of caps prior to application of each of said caps onto a corresponding container from a plurality of containers, wherein each of said caps has a feature that defines an angular orientation of said cap, wherein said angular orientation results from rotation of said cap about an axis defined by a line normal to a surface of said cap, wherein said closure element is configured to engage an opening of a container that is in an open state, thereby transforming said container into a container that is in a closed state, wherein each of said caps from said plurality of caps has a corresponding random angular orientation, wherein said supplying device is configured to hold each of said caps in said corresponding random angular orientation, wherein said supplying device is configured to transport each of said caps along a transport path, wherein during transport along said transport path, each of said caps retains said corresponding random angular orientation, and wherein said cap detecting system is placed along said transport path to record said corresponding random angular orientations prior to placement of said caps on corresponding containers, wherein, in said open state, a mouth of said container is open so that liquid can pass from outside said container into an interior of said container, wherein, in said closed state, said mouth is closed so that liquid trapped inside said container by a closure element can no longer pass from said interior of said container to outside said container as a result of said mouth having blocked by said closure element, whereby, by the time a closure element is first placed on a corresponding container, said random angular orientation of said closure element has already been recorded by said cap detecting system, and whereby said container can be rotated to a correct position corresponding to said random angular orientation before said closure element is first applied to said container, whereby containers that are in an open state are transformed into said closed state by application of said closure cap, wherein said supplying device is configured to supply caps selected from the group consisting of twist-off caps, ring-pull caps, and crown caps.

18. The apparatus of claim 17, further comprising a container detecting system, wherein containers that are in said open state are transported on turntables prior to application of closure elements, wherein said container detecting system provides data that, when combined with data provided by said cap detecting system, enables said containers on said turntable to be rotated in relation to the a recognized random orientation of said closure element.

19. The apparatus according to claim 17, wherein the cap detecting system is located for generating a head-on photograph of each closure element.

20. The apparatus according to claim 17, wherein the cap detecting system is located for generating a photograph of said feature.

* * * * *